United States Patent [19]

Haley

[11] 4,261,398

[45] Apr. 14, 1981

[54] DEEPWATER OFFSHORE LOADING APPARATUS

[75] Inventor: Frank P. Haley, Upland, Calif.

[73] Assignee: FMC Corporation, San Jose, Calif.

[21] Appl. No.: 48,306

[22] Filed: Jun. 13, 1979

Related U.S. Application Data

[63] Continuation of Ser. No. 934,736, Aug. 21, 1978, abandoned.

[51] Int. Cl.[3] ..... B65B 31/04

[52] U.S. Cl. ..... 141/387; 137/615

[58] Field of Search ..... 137/615; 141/387, 388, 141/279, 284; 248/59, 280, 281; 285/152, 168

[56] References Cited

U.S. PATENT DOCUMENTS

| | | | |
|---|---|---|---|
| 780,083 | 1/1905 | Williams et al. | 141/387 |
| 3,409,046 | 11/1968 | Means | 141/387 |
| 3,434,442 | 3/1969 | Manning | 141/387 |
| 3,675,680 | 7/1972 | Frolich et al. | 141/387 |
| 3,799,197 | 3/1974 | Gibbons | 141/387 |
| 3,921,557 | 11/1975 | Keptejin | 141/387 |
| 3,938,676 | 2/1976 | Croese | 141/387 |
| 3,980,037 | 9/1976 | Tuson | 141/387 |
| 4,090,538 | 5/1978 | Kotcharian | 141/387 |
| 4,121,616 | 10/1978 | Lochte et al. | 141/387 |

*Primary Examiner*—Houston S. Bell, Jr.

*Attorney, Agent, or Firm*—L. B. Guernsey; W. W. Ritt, Jr.; R. B. Megley

[57] ABSTRACT

The deepwater offshore loading system is especially suited for transferring petroleum from a floating storage and loading terminal to a marine tanker and for providing for relative movement between the tanker and the terminal. The system comprises a support boom mounted on the deck of a terminal, a pair of fluid conduits extending generally horizontal along the boom from risers at the deck, a pair of vertical fluid conduits and a first coaxial swivel joint connected between the outboard ends of the boom conduits and the upper ends of the vertical fluid conduits. A pair of horizontal conduits are mounted one above the other in a generally horizontal position with the inboard ends of the horizontal conduits connected to a header which is pivotally connected to the lower ends of the vertical fluid conduits. Another header is connected between the outboard ends of the horizontal conduits and a dual universal joint. Another coaxial swivel joint connects the dual universal joint to a pair of manifold ports on a marine tanker. The system provides a pair of separate and distinct fluid paths between the marine tanker and the deck of the floating storage terminal, one path for transferring the fluid and the other path for returning vapor to the fluid supply area.

12 Claims, 10 Drawing Figures

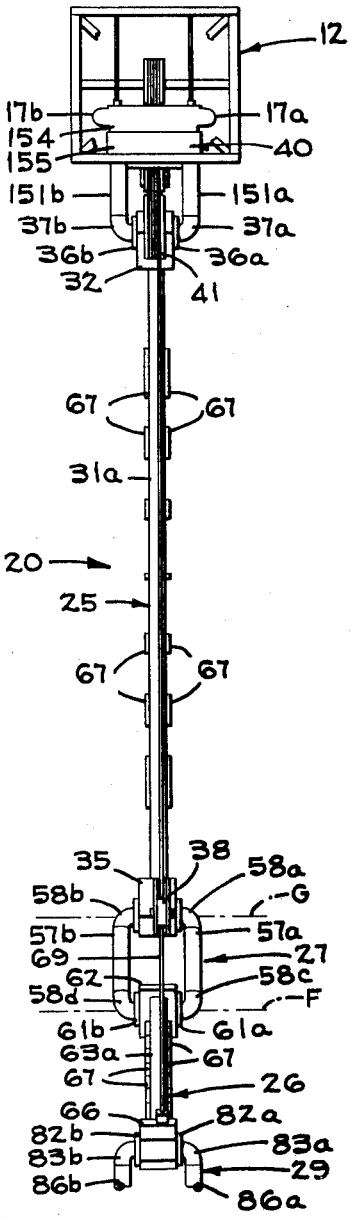
FIG_4
FIG_5
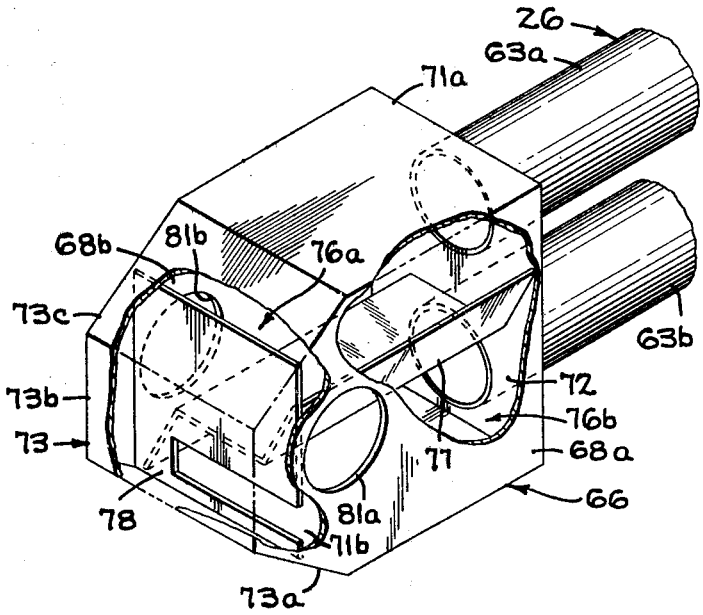
FIG_7
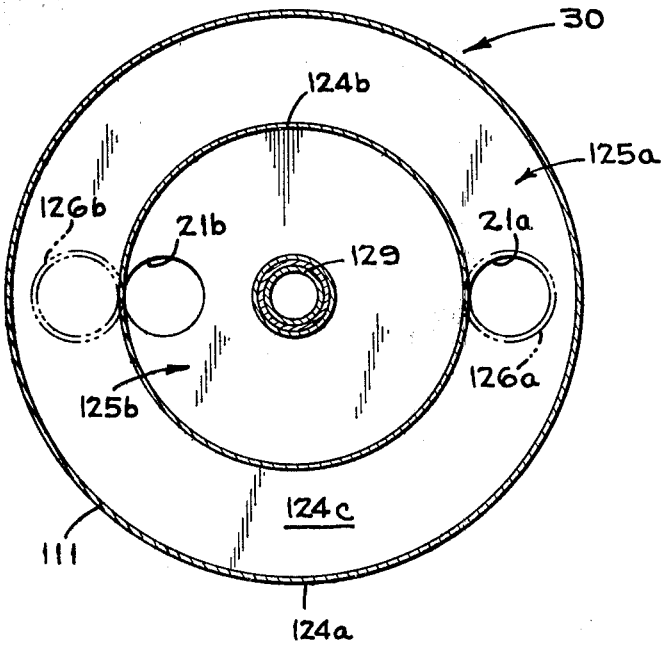

DEEPWATER OFFSHORE LOADING APPARATUS

This is a continuation of application Ser. No. 934,736 filed Aug. 21, 1978, now abandoned.

BACKGROUND OF THE INVENTION

1. Field of the Invention

This invention relates to fluid loading systems and more particularly to marine loading arms for transferring the fluid between an offshore terminal and a marine tanker and for returning vapor to the offshore terminal.

2. Description of the Prior Art

The production of oil and gas from offshore wells has developed into a major endeavor of the petroleum industry, and this growth has lead to the development of means for transporting petroleum products from offshore wells to shore-based refineries or storage facilities. Many of the wells are being drilled and completed in deepwater locations where the use of marine tankers of very large capacity constitutes the most practical and efficient method of transporting the petroleum products.

Some of the prior art facilities include a fluid handling means such as a fixed mooring buoy or a floating platform to which the tanker may be moored while loading. The tanker and floating platform move relative to each other during the loading operations due to wind, tides and the amount of fluid which is loaded to the tanker. The height of the tanker water line changes as the tanker is loaded or unloaded thus requiring that a flexible or articulated hose be connected between the tanker and the floating platform. When flexible hoses are used a tender is normally required to assist the tanker in picking up the flexible hoses for connection to the tanker's manifold. Such an arrangement not only requires the use of a tender but movement of the tanker may cause the flexible hoses to be broken. Also the hoses are bulky, heavy, hard to handle and require a relatively large crew of workers to connect the hose to the tanker.

Some of the other prior art loading facilities include a marine loading arm having relative complex articulated arms that are heavy, bulky, relatively expensive and require complex balancing systems because the balance of these arms changes as the fluid content of the arm changes. In addition, the transfer of large quantities of crude oil and other hydrocarbon products between the offshore facilities and the oil tanker is invariably accompanied by the generation of large volumes of vapor. At the present time these vapor are not recovered but are vented into the atmosphere where they may form explosive pockets, thereby creating a fire and safety hazard. In addition, the loss of these vapors causes shrinkage of the hydrocarbon product being transferred, which of course is quite expensive. These vapors also contaminate the air and contribute to the generation of "smog".

What is needed is petroleum transfer apparatus which is relatively easy to connect between the offshore loading facilities and a marine tanker, which provides for relative movement between the tanker and the loading facility and which recovers the vapors generated in the loading of the tanker and returns these vapors to the offshore loading facilities.

SUMMARY OF THE INVENTION

The present invention comprises an offshore loading system for transferring fluid from a first fluid handling means to a second handling means, provides for relative movement between the two handling means and provides a pair of separate and distinct fluid paths between the two handling means. One of these fluid paths is for transferring the fluid between the offshore terminal and the tanker while the second path provides a return for the vapor which is generated during the loading of the tanker. This invention overcomes some of the disadvantages of the prior art by employing a tower or other suitable vertical support structure that is mounted on a platform or other fluid handling means, and a generally horizontally-disposed support boom connected to the tower or other support structure. A pair of boom conduit members are mounted in a generally horizontal position along the support boom. The outboard end of each of the boom conduit members is connected to a first coaxial swivel joint. The upper ends of each of a pair of vertical conduit members are connected by one of a pair of swivel joints through the first coaxial swivel joints to a corresponding one of the outboard ends on the boom conduit members. Means are provided for pivotally connecting the lower end of each of the vertical members to a corresponding end of one of a pair of horizontal conduit members. A second coaxial swivel joint is connected to a pair of tanker manifold ports and a pair of universal joint means are connected between the second coaxial swivel joint and the outboard end of the corresponding one of the horizontal conduit members. Each of the coaxial swivel joints includes a pair of inlet ports, a pair of oultet ports, a pair of concentric chambers and means for connecting each of the concentric chambers between one of the inlet ports and a corresponding one of the outlet ports regardless of the rotational position of the input ports relative to the output ports. The horizontal conduit members are positioned one above the other in a generally horizontal position to reduce the torque stresses which occur in a side by side arrangement when one of the horizontal conduit members is full and the other conduit member is empty.

BRIEF DESCRIPTION OF THE DRAWINGS

FIG. 4 is an end view of the offshore loading system of FIG. 1 taken in the direction of the arrows 4—4 of FIG. 2.

FIG. 5 is an enlarged isometric view of a portion of the apparatus of FIG. 2 with portions broken away.

FIG. 7 is a sectional view of the dual coaxial swivel joint taken along the line 7—7 of FIG. 6.

DESCRIPTION OF THE PREFERRED EMBODIMENT

An offshore loading apparatus having dual conduits according to the present invention comprises a tower or other suitable vertical support structure 10 (FIG. 1) mounted on the top of a platform 11 and having a generally horizontally-disposed support boom 12 connected at the central portion thereof to the top of the support structure 10. The central portion of the support boom 12 may be rotatably connected to the top of the support structure 10 or the support structure 10 may be rotatably connected to the platform 11 in the manner commonly used in the fluid loading art. The details of these commonly used devices are not considered to be a part of this invention.

Figure 1:
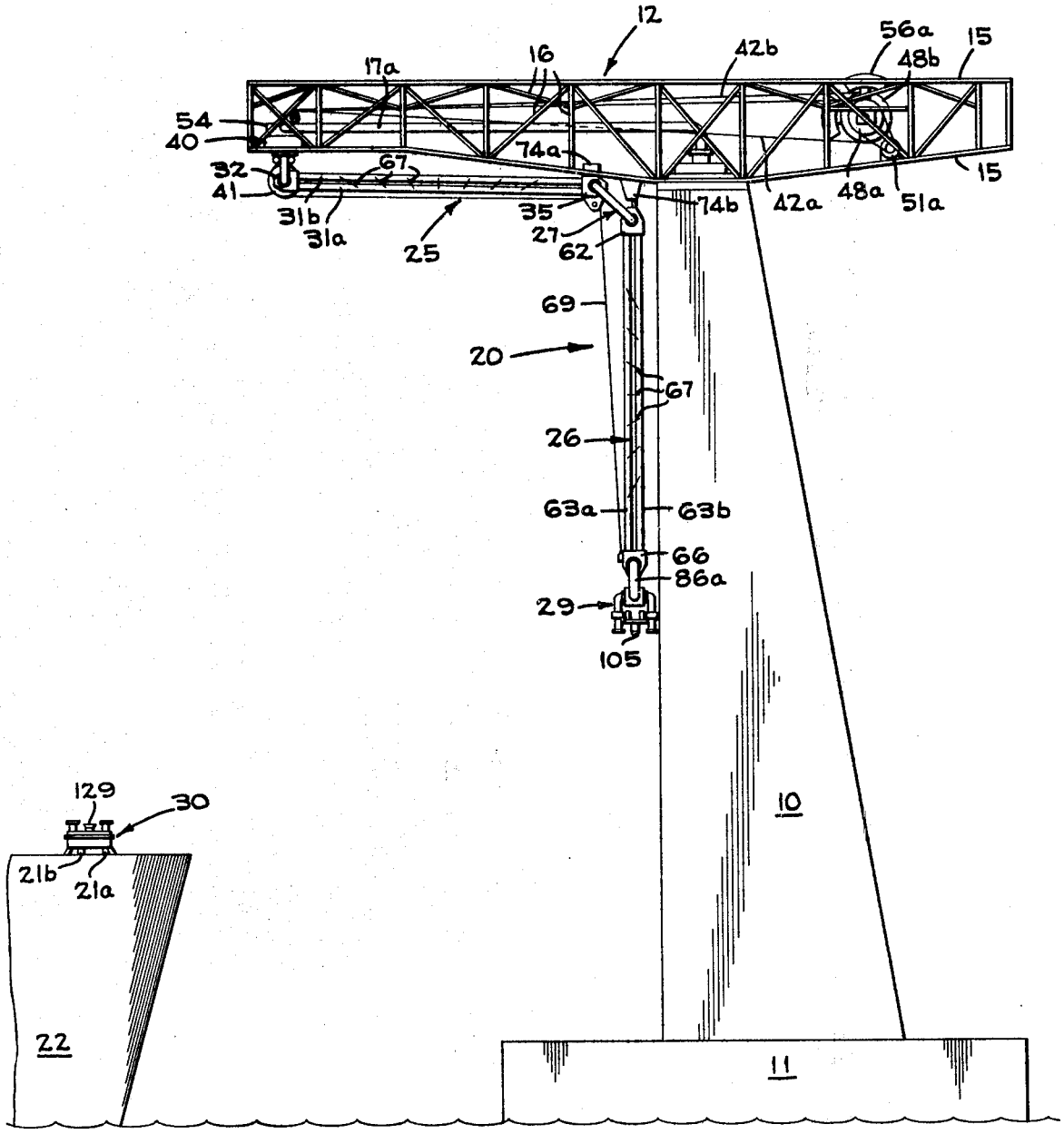
FIG. 1 is a side elevation of an offshore loading system according to the present invention, with a loading apparatus in a stored position adjacent a support tower.

The support boom 12 (FIG. 1) comprises a plurality of horizontal structure members 15 interconnected by a plurality of cross members 16 to form a sturdy but lightweight support structure for the loading apparatus. The support boom 12 includes a pair of boom conduit members 17*a*, 17*b* (only the member 17*a* is shown in FIG. 1) mounted between the outboard end of the support boom 12 and the top of the support structure 10. Other pipes (not shown) connect the inboard end of each of the boom conduit members 17*a*, 17*b* with storage facilities which may be located in or below the platform 11.

An articulated loading arm 20 (FIGS. 1 and 2) connects the outboard end of each of the boom conduit members to a corresponding one of a pair of tanker manifolds 21*a* , 21*b* to provide a pair of separate and distinct fluid paths between a marine tanker 22 and the storage facilities at the platform 11. For example, one of these fluid paths may convey fluid petroleum from the storage facilities to the tanker and the other path may return vapors from the tanker to the storage facilities. The loading arm 20 includes an upper section 25, a lower section 26, and a linking section 27 each having a pair of conduit members throughout the length thereof. The upper section 25 is pivotally connected to the boom conduit members 17*a*, 17*b* and is rigidly connected to the upper end of the link section 27. The upper end of the lower section 26 is pivotally connected to the lower end of the linking section 27 and the lower end of the lower section 26 is connected to the tanker 22 by a universal type connector 29 and a lower coaxial swivel joint 30.

Figures 2, 3:
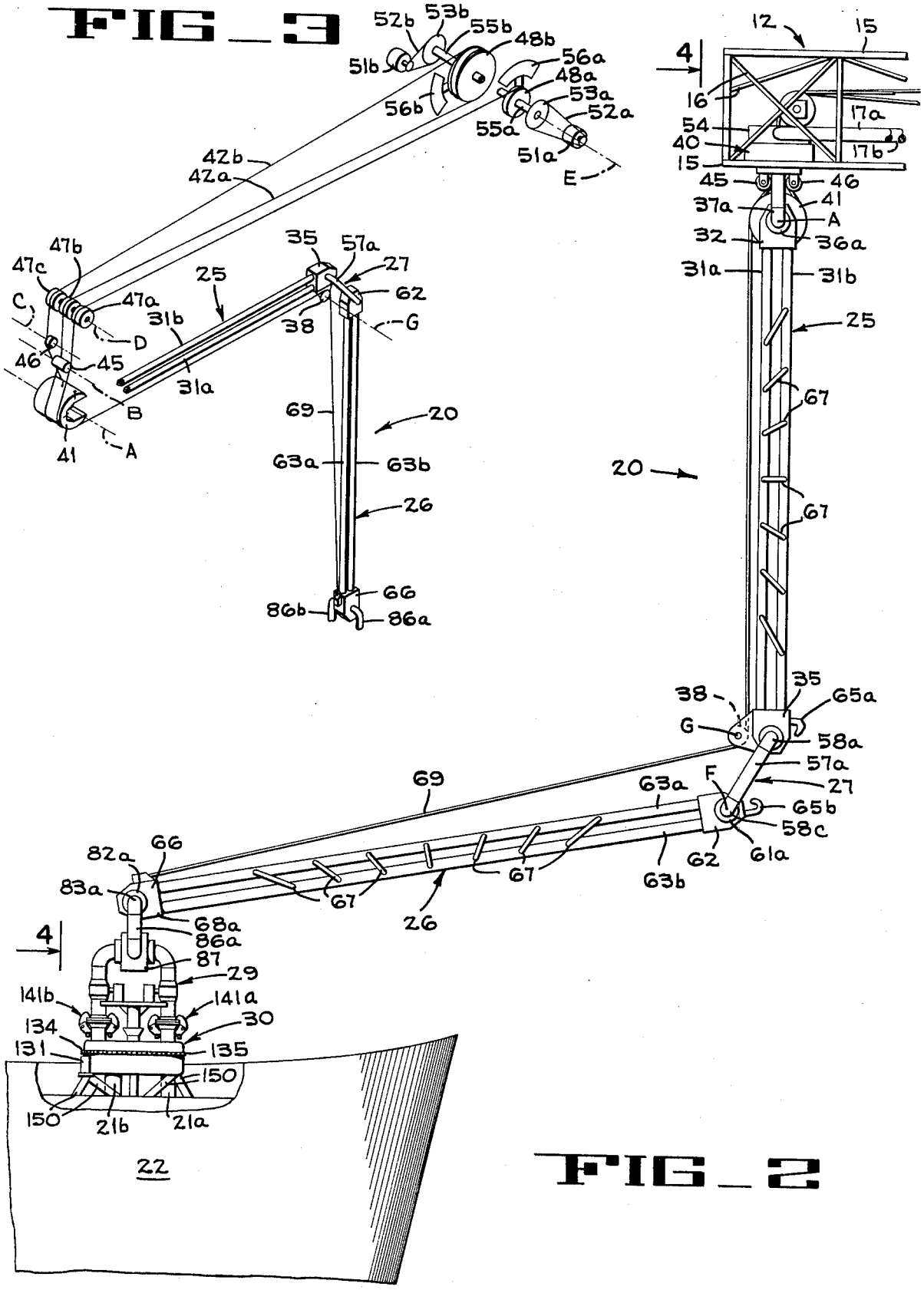
FIG. 2 is an enlarged side elevation of a portion of the loading apparatus of FIG. 1 with the outboard end of the apparatus connected in operating position to a marine tanker.
FIG. 3 is a schematic drawing of the cables and sheaves used in positioning the loading apparatus of FIG. 1.
Figure 8:
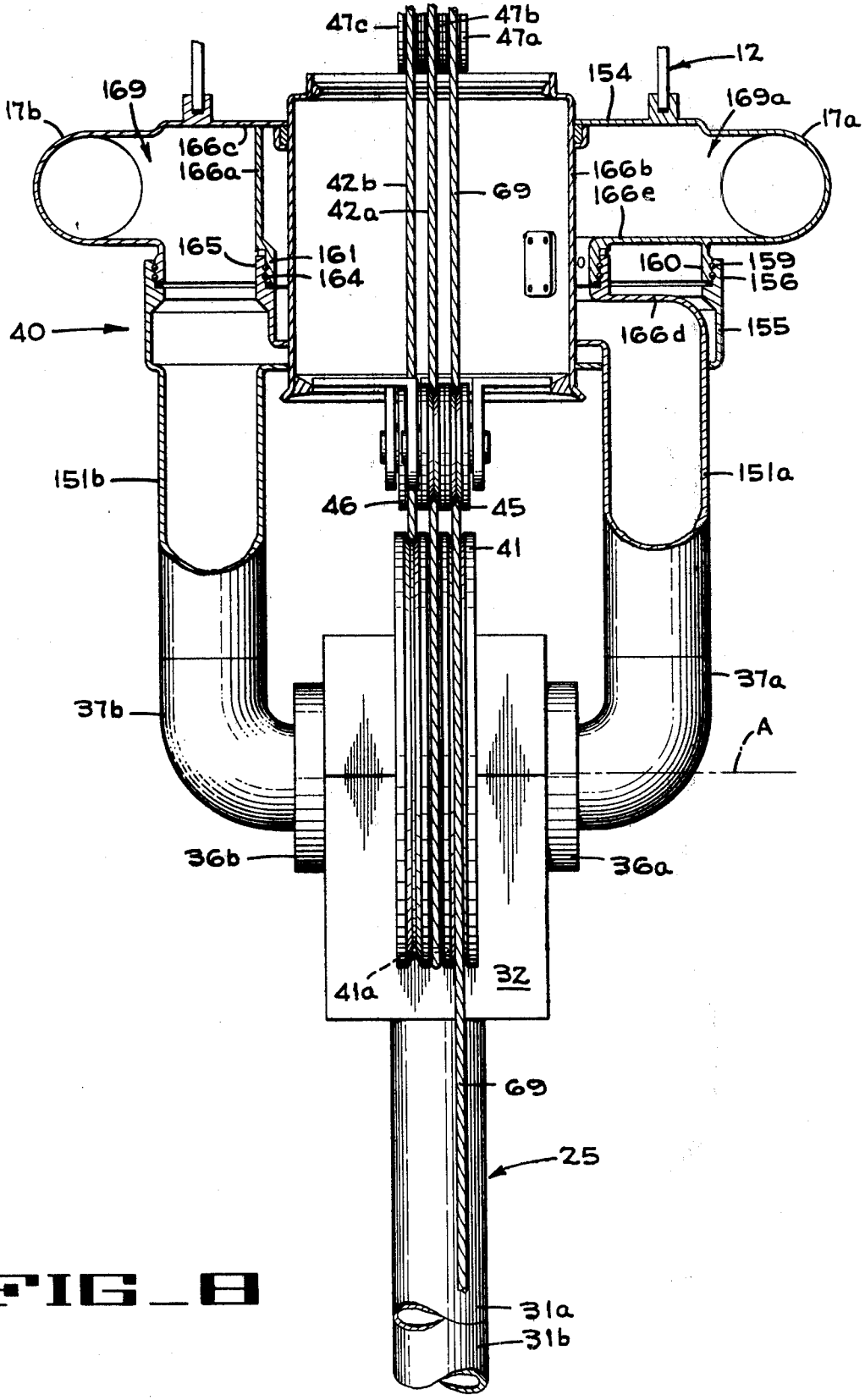
FIG. 8 is an enlarged view of the dual coaxial swivel joint which is connected to the horizontal boom with portions in section.

The upper section 25 of the loading arm includes a pair of vertical conduit members 31*a*, 31*b* (FIGS. 1 and 2) each having the upper end connected to an upper header 32 (FIGS. 1, 2, 4 and 8) and the lower end connected to a first central header 35. A sheave 38 is mounted on the central header 35 for rotation about an axis G (FIGS. 2–4). A pair of swivel joints 36*a*, 36*b* (FIG. 8) are each connected between the upper header 32 and a corresponding one of a pair of pipe elbows 37*a*, 37*b* with the pipe elbows connected to a coaxial swivel joint 40. A first large sheave 41 (FIGS. 2, 3 and 8) is mounted on the upper header 32 for rotation about an axis A (FIGS. 2 and 8) with the sheave 41 fixed to the header 32. Power to rotate the header 32 and the sheave 41 about the axis A is provided by a pair of inboard cables 42*a*, 42*b* (FIGS. 3 and 8) each of which has the outboard end thereof connected to the sheave 41 by a pin 41*a* (FIG. 8).

The cable system (FIG. 3) also includes a plurality of sheaves 45–48*b*, a pair of drive motors 51*a*, 51*b*, a pair of drive belts 52*a*, 52*b* and a pair of pulleys 53*a* 53*b*. The sheaves 45 and 46 (FIGS. 2 and 3) are each mounted for rotation about an axis B, C, respectively, while the sheaves 47*a*–47*c* are each mounted for rotation about an axis D. The sheaves 48*a*, 48*b* are mounted for rotation about an axis E, with power to rotate the sheave 48*a* supplied by the motor 51*a* coupled to the sheave 48*a* by the belt 52*a*, the pulley 53*a* and a shaft 55*a*. Power to rotate the sheave 48*b* is supplied by the motor 51*b* which is coupled to the sheave 48*b* by the belt 52*a*, the pulley 53*b* and a shaft 55*b*. The motor 51*b* and the cables 42*a*, 42*b* provide power to rotatably position the upper section 25 (FIGS. 1–3) of the articulated arm 20 about the axis A.

A counterweight 56*b* attached to the sheave 48*b* counterbalances the weight of the articulated arm 20 by moving the counterweight into the horizontal position shown in FIG. 3 when the upper section 25 of the arm 20 is horizontal and moving the counterweight into a vertical position below the sheave 48*b* when the upper section 25 is in a vertical position as shown in FIG. 2.

When the motor 51*b* (FIG. 3) rotates the sheave 48*b* (FIGS. 1 and 3) in a counterclockwise direction (FIGS. 1 and 3) the cables 42*a*, 42*b* cause the sheave 41*b* (FIG. 3) and the upper header 32 (FIGS. 2 and 8) to rotate in a clockwise direction thereby moving the upper section 25 of the articulated arm 20 from the horizontal position shown in FIG. 3 toward the vertical position shown in FIG. 2.

The linking section 27 (FIG. 4) includes a pair of links of pipe 57*a*, 57*b* having an elbow 58*a*–58*d* connected at either end. The upper ends of the elbows 58*a*, 58*b* are each welded or otherwise secured to the first central header 35 so that the elbows 58*a*, 58*b* do not pivot relative to the header 35. The lower ends of the elbows 58*c*, 58*d* are each connected to a corresponding swivel joint 61*a*, 61*b* mounted on the sides of the second central header 62 (FIGS. 2–4) so that the header 62 can rotate about an axis F (FIGS. 2 and 4).

The lower section 26 (FIGS. 1 and 2) includes a pair of horizontal conduit members 63*a*, 63*b* connected between the central header 62 and a lower header 66 (FIGS. 2 and 4). When the lower section 26 is in a generally horizontal position the horizontal conduit members 63*a*, 63*b* are mounted one above the other to accommodate any difference in length of the conduit members which may result because of a difference in temperature of the fuel moving through the two conduit members. If one of the conduit members is empty and the other conduit member is full or if one conduit member is full of fluid and the other is filled with gas and the conduit members were in a side-by-side position this would place undue stress on the swivel joints 61*a*, 61*b* (FIG. 4). A plurality of structural links 67 pivotally connected between the conduit members 63*a*, 63*b* maintain the conduit members in a generally parallel position when one of the conduit members contracts or expands more than the other. The upper section 25 is constructed in a similar manner with the conduit members 31*a*, 31*b* mounted one above the other when the upper section is in a generally horizontal position. A plurality of structural links 67 maintains the conduit members 31*a*, 31*b* in a generally parallel position.

A pair of hooks 65*a*, 65*b* (FIG. 2) connected to the headers 35 and 62 respectively and a pair of latches 74*a*, 74*b* (FIG. 1) connected to the support boom 12 retain the articulated arm in the stowed position shown in FIG. 1. The latches 74*a*, 74*b* can be remotely controlled to hold or to release the hooks by either hydraulic means (not shown) or by other control means which is well known in the art.

Power to rotate the lower section 26 of the articulated arm 20 is supplied by the motor 51*a* (FIG. 3) which is coupled to the header 66 at the outboard end of the lower section 26 by a cable 69 which is threaded over the sheaves 38, 41, 47*a* and connected to the sheave 48*a*. A counterweight 56*a* attached to the sheave 48*a* counterbalances the weight of the lower section 26 of the articulated arm 20 by moving the counterweight 56*a* into a horizontal position when the lower section 26 moves into a horizontal position (FIG. 2). The counterweight 56*a* moves into the vertical position shown in FIG. 3 when the lower section 26 is in a vertical position (FIG. 3).

In order to reduce the friction between the cable 69 and the sheave 41 a series of small rollers (not shown) may be mounted around the periphery of the right portion (FIG. 3) of the sheave 41. Other appartus for permitting the cable to move over the surface of the sheave 41 without excessive friction can also be used. The details of this apparatus are not considered critical to the present invention.

Each of the headers 32, 35 and 62 are similarly constructed to the header 66 which is disclosed in FIG. 5. The header 66 includes a box-like structure having a pair of parallel sidewalls 68*a*, 68*b* interconnected by a top plate 71*a*, a bottom plate 71*b*, a back wall 72 and a plurality of angle plates 73*a*–73*c* which form a front wall 73. The ends of the conduit members 63*a*, 63*b* are welded to the back wall 72 with the end of the upper conduit member 63*a* connected to an upper chamber 76*a* and the end of the lower conduit member 63*b* connected to a lower chamber 76*b*. A pair of baffle plates 77, 78 provides separation between the upper and lower chambers. The upper chamber 76*a* connects the upper conduit member 63*a* to an opening 81*b* in the sidewall 68*b* and the lower chamber 76*b* connects the lower conduit member 63*b* to an opening 81*a* in the sidewall 68*a* to provide two separate and distinct fluid paths between the conduit members 63*a*, 63*b* and the openings 81*b*, 81*a* in the sidewalls.

Figure 6:
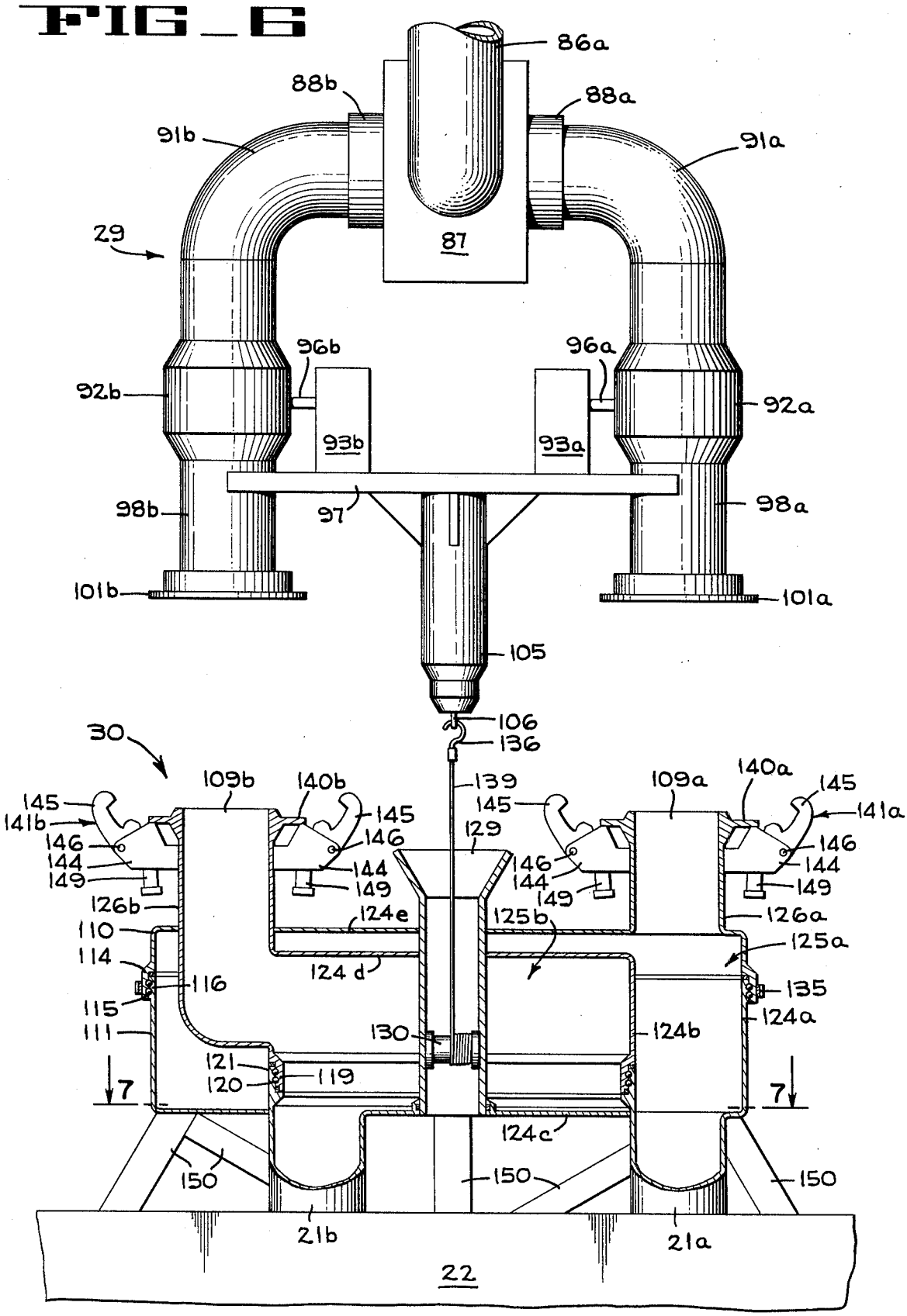
FIG. 6 is an enlarged view of the universal joint and of the dual coaxial swivel joint which is connected to the tanker's manifold as shown in FIG. 2 with a portion in section.

A pair of swivel joints 82*a*, 82*b* (FIGS. 2 and 4) are each connected between one of a pair of pipe elbows 83*a*, 83*b* and a corresponding one of the sidewalls 68*a*, 68*b* (FIG. 5) of the header 66 where the swivel joints 82*a*, 82*b* are mounted around the openings 81*a*, 81*b* respectively. The lower end of the pipe elbows 83*a*, 83*b* are each connected to one of a pair of short sections of pipe 86*a*, 86*b* respectively (FIG. 4). The sections of pipe 86*a*, 68*b* (only one of which is shown in FIGS. 2 and 6) are each connected to a header 87 (FIGS. 2 and 6) having a pair of swivel joints 88*a*, 88*b* connected thereto. A pair of elbows 91*a*, 91*b* interconnect the swivel joints 88*a*, 88*b* to one of a pair of power operated valves 92*a*, 92*b* respectively. A pair of hydraulic motors 93*a*, 93*b* are coupled to the valves 92*a*, 92*b* by a pair of shafts 96*a*, 96*b* respectively. The motors 93*a*, 93*b* are mounted on a platform 97 which is welded or otherwise connected to a pair of vertical pipe sections 98*a*, 98*b* with the pipe sections each connected to the valves 92*a*, 92*b* respectively. The motors 93*a*, 93*b* and the valves 92*a*, 92*b* provide remote controlled operation of the shut off and turn on of the flow of fuel from the outboard end of the articulated arm 20. The lower ends of the vertical pipe sections 98*a*, 98*b* each includes a connecting end flange 101*a*, 101*b* for connection to the coaxial swivel joint 30. An annular guide pin 105 (FIG. 6) having a screw eye 106 connected at the bottom end thereof is attached to the center of the platform to aid in guiding the connecting flanges 101*a*, 101*b* into connecting alignment with the swivel joint 30.

The coaxial swivel joint 30 (FIGS. 1 and 6) includes means for connecting the tanker manifold 21*a* to an input port 109*a* and for connecting the tanker manifold 21*b* to an input port 109*b* regardless of the rotative positions of these input ports. The coaxial swivel joint 30 includes an annular upper body portion 110 (FIG. 6) which swivels relative to an annular lower body portion 111 about a common vertical axis. The free end of the outer diameter of the upper body portion 110 is radially expanded and the inner wall of the resultant cup 114 constitutes the outer race of a ball bearing 115, while the adjacent end portion 116 of the lower body portion 111 forms the inner face of said bearing. Another bearing is formed where the free lower end of the upper body portion 110 is radially contracted and the outer wall of the resultant cup 119 constitutes the inner race of a ball bearing 120, while the adjacent end 121 of the lower body portion 111 forms the race of the bearing 120.

The upper and lower body portions of the coaxial swivel joint 30 includes a plurality of walls 124*a*–124*e* (FIG. 6) which divide the interior of a swivel joint into a pair of chambers 125*a*, 125*b*. The chamber 125*a* (FIGS. 6 and 7) connects the tanker manifold 21*a* to an inlet tube 126*a* and the chamber 125*b* connects the tanker manifold 21*b* to an inlet tube 126*b* regardless of the rotative position of the upper body portion 110 of the swivel joint 30. A guide funnel 129 (FIGS. 6 and 7) having the lower end thereof welded or otherwise connected to the lower body portion 111 of the coaxial swivel joint 30 includes a hydraulic winch 130 for pulling the connecting end flanges 101*a*, 101*b* into position for connection to the coaxial swivel joint 30. A hydraulic motor 131 (FIG. 2) connected to the deck of the marine tanker 22 includes a small gear 134 which meshes with a larger gear 135 (FIG. 2) connected to the upper body portion 110 to rotate the inlet tubes 126*a*, 126*b* into rotational alignment with the connecting end flanges 101*a*, 101*b* of the universal connector 29. A hook 136 is connected to the eye 106 in the guide pin 105 and a cable 139 and the winch 130 pull the connector 29 down until the end flanges 101*a*, 101*b* are connected to a corresponding one of a pair of flanges 140*a*, 140*b*.

The connector 29 and the coaxial swivel joint 30 clamped together by a pair of sets of quick couplers 141*a*, 141*b* (FIGS. 2 and 6). Each of the quick couplers include a plurality of standards 144 (FIG. 6) which are welded or otherwise connected to an inlet tube 126*a*, 126*b*. A clamp member 145 is pivotally secured to each of the standards 144 by a pin 146. Power to pivotally move each of the clamp members is provided by a hydraulic ram 149. Details of the construction and operation of one such quick coupler can be found in a copending patent application entitled "Mechanism for Clamping Plates", Ser. No. 882,715, filed Mar. 2, 1978, by the inventor of the present invention. A plurality of support members 150 (FIGS. 2 and 6) connected between the deck of the marine tanker 22 and the lower body portion 111 secure the coaxial swivel joint 30 to the marine tanker.

The upper coaxial swivel joint 40 (FIGS. 1, 2, 4, 8 and 9) includes means for connecting the boom conduit member 17*a* (FIG. 8) to a vertical pipe 151*a* and for connecting the boom conduit member 17*b* to a vertical pipe 151*b* regardless of the rotative positions of the vertical pipes 151*a*, 151*b*. The vertical pipes 151*a*, 151*b* are each connected to one of the elbows 37*a*, 37*b* adjacent the upper header 32. The coaxial swival joint 40 (FIG. 8) includes an upper body portion 154 which is fixed to the support boom 12 (FIGS. 1, 2 and 8) and a lower body portion 155 which swivels relative to the upper body portion about a common vertical axis. The free upper end of the outer diameter of the lower body portion 155 (FIG. 8) is radially expanded and the inner wall of the resultant cup 156 constitutes the outer race of a ball bearing 159, while the adjacent end 160 of the upper body portion forms the inner race of said ball bearing. Another bearing is formed where the free lower end of the upper body portion 154 is radially contracted and the outer wall of the resultant cup 161 constitutes the inner race of the ball bearing 164, while the adjacent end 165 of the lower body portion forms the outer race of the bearing 164.

The upper and lower body portions of the coaxial swivel joint 40 include a plurality of walls 166*a*–166*e* (FIG. 8) which divide the interior of the swivel joint 40 into a pair of chambers 169*a*, 169*b*. The chamber 169*a* connects the vertical pipe 151*a* to the boom conduit member 17*a* and the chamber 169*b* connects the vertical pipe 151*b* to the boom conduit member 17*b* regardless of the rotational position of the lower body portion 155 of the coaxial joint 40.

SECOND EMBODIMENT

Figures 9, 10:
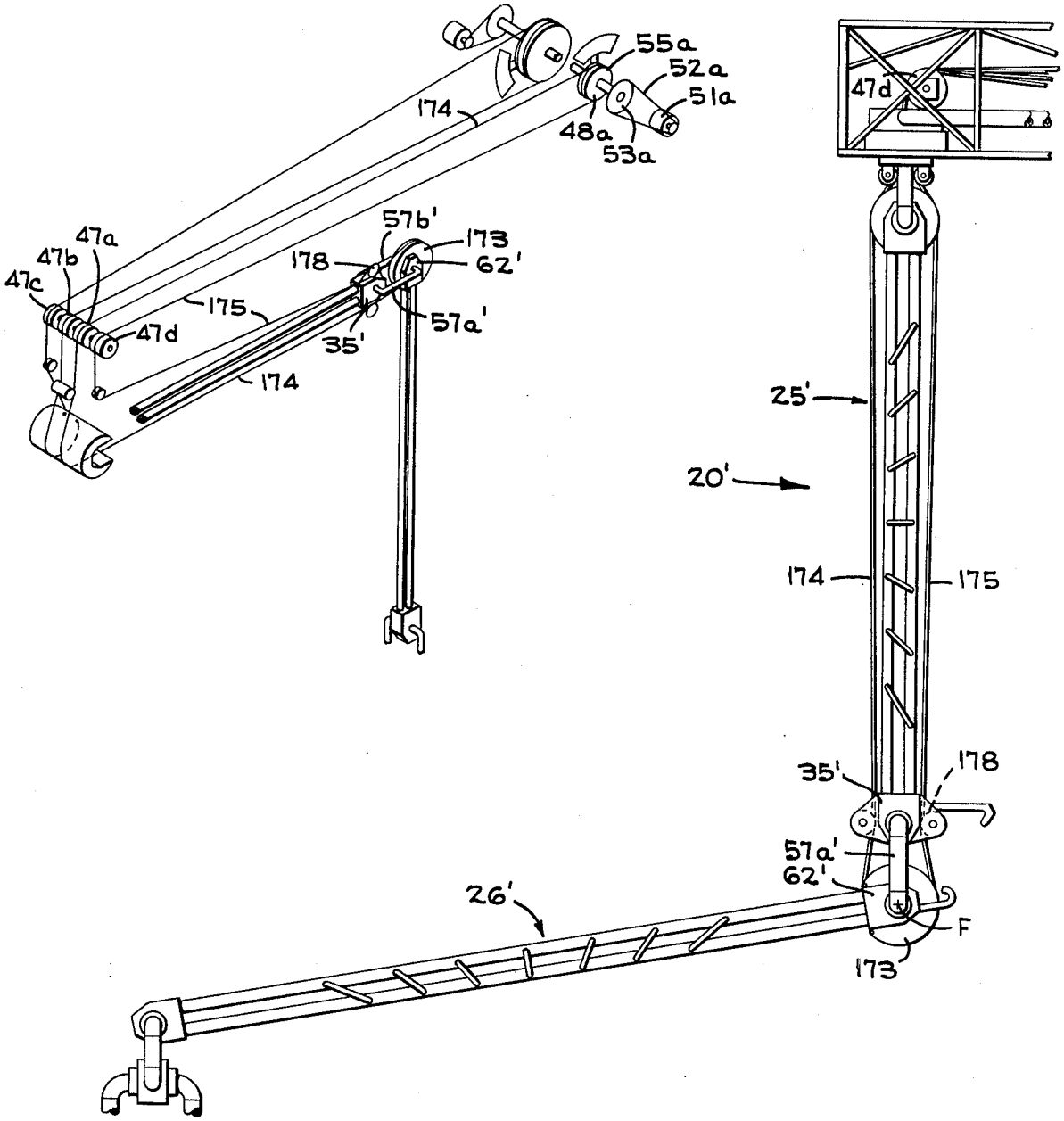
FIG. 9 is an enlarged side elevation of another embodiment of the loading apparatus of FIG. 1.
FIG. 10 is a schematic drawing of the cables and sheaves used in positioning the loading apparatus of FIG. 9.

Another embodiment of the articulated arm 20' disclosed in FIGS. 9 and 10 includes a sheave 173 and a pair of control cables 174, 175 connected to the inboard end of the lower section 26' of the articulated arm 20 to position the outboard end of the lower section 26' of the articulated arm. The sheave 173 and a header 62' are pivotally mounted at the lower ends of the lengths of pipe 57*a*', 57*b*' (only one of which is shown in FIG. 9). Power to rotate the header 62', the sheave 173 and the lower section of the arm 26' is provided by the motor 51*a* which couples the power through the belt 52*a*, pulley 53*a*, shaft 55*a*, sheave 48*a* and the cables 174, 175. The cable 175 is routed over a sheave 47*d* (FIG. 10) which is mounted on the same axis as the sheaves 47*a*–47*c*, and over a sheave 178 which is mounted on the central header 35' (FIG. 9) at the lower end of the section 25'.

The present invention provides two separate and distinct fluid paths between a floating storage terminal and a marine tanker. Petroleum fuel can be transferred along one path between the storage terminal and the tanker and vapors can be returned along the other path. The two paths include two conduit members which are mounted one above the other when the members are horizontally oriented to reduce strain on the swivel joints and to allow for unequal contractions or expansions of the conduit members due to different temperatures therein. Means are provided for individual positioning of the upper and lower sections of the articulated loading arm and coaxial swivel joints are provided at the upper and lower ends of the articulated arm.

Although the best mode contemplated for carrying out the present invention has been herein shown and described, it will be apparent that modification and variation may be made without departing from what is regarded to be the subject matter of the invention.

I claim:

1. Apparatus for loading and unloading marine tankers from a storage facility and to provide for relative movement between said tankers and said facility while providing a plurality of separate and distinct fluid paths between said tankers and said facility, said apparatus comprising:

a support structure;

a support boom connected to said support structure;

a plurality of boom conduit members mounted along said support boom;

a first coaxial swivel joint connected to the outboard end of each of said boom conduit members;

a plurality of vertical conduit members;

means for pivotally connecting the upper end of each of said vertical conduit members to said coaxial swival joint so that said vertical conduit members are substantially parallel and reside one above the other in a generally vertical plane when they are in a generally horizontal position;

a plurality of horizontal conduit members;

means for pivotally connecting the inboard end of each of said horizontal conduit members to the lower end of a corresponding one of said vertical conduit members so that said horizontal conduit members are substantially parallel and reside one above the other in a generally vertical plane when they are in a generally horizontal position;

a second coaxial swivel joint connected to a plurality of tanker manifold ports; and a plurality of universal joint means each connected between said second coaxial swivel joint and the outboard end of a corresponding one of said horizontal conduit members.

2. Apparatus for loading and unloading as defined in claim 1 wherein said means for pivotally connecting the inboard end of each of said horizontal conduit members to the lower end of one of said vertical conduit members includes a header having a plurality of inlet ports, a plurality of outlet ports and a plurality of passageways, each of said passageways being connected between one of said inlet ports and a corresponding one of said outlet ports; and including means for pivotally connecting the lower end of each of said vertical conduit members to a corresponding one of said outlet ports in said header.

3. Apparatus for loading and unloading as defined in claim 1 wherein each of said coaxial swivel joints includes a plurality of inlet ports, a plurality of outlet ports, a plurality of concentric chambers, and means for connecting each of said concentric chambers between one of said inlet ports and a corresponding one of said outlet ports.

4. Apparatus for loading and unloading as defined in claim 3 including means for connecting each of said outlet ports of said first coaxial swivel joint to the outboard end of a corresponding one of said boom conduit members, and means for pivotally connecting each of said inlet ports of said first coaxial swivel joint to the upper end of a corresponding one of said vertical conduit members.

5. Apparatus for loading and unloading marine tankers from a storage facility and to provide for relative movement between said tankers and said facility while providing a plurality of separate and distinct fluid paths between said tankers and said facility, said apparatus comprising:

a support structure;

a support boom connected to said support structure;

a plurality of boom conduit members mounted in a generally horizontal position along said support boom;

plurality of vertical conduit members;

a first coaxial swivel joint having a plurality of output ports and having a plurality of chambers for coupling the outboard end of each of said boom conduit members to a corresponding one of said output ports regardless of the rotational position of said output ports relative to said boom conduit members;

means for pivotally connecting the upper end of each of said vertical conduit members to a corresponding one of said output ports in said first coaxial swivel joint with said vertical conduit members in a parallel arrangement;

a plurality of horizontal conduit members;

means for pivotally connecting the inboard end of each of said horizontal conduit members to the lower end of a corresponding one of said vertical members with said horizontal conduit members in a parallel arrangement and residing one above the other when said horizontal members are in a generally horizontal position;

a second coaxial swivel joint having a plurality of input ports, a plurality of output ports and a plurality of chambers for coupling each of said input ports to a corresponding one of said output ports; and means for pivotally connecting the outboard end of each of said horizontal conduit members to a corresponding one of said input ports of said second coaxial swivel joint.

6. Apparatus for loading and unloading as defined in claim 5 including a plurality of tanker manifolds and means for connecting each of said output ports of said second coaxial swivel joint to a corresponding one of said mainfolds.

7. Apparatus for loading and unloading as defined in claim 5 wherein said second coaxial swivel joint includes means for coupling each of said chambers between one of said input ports and a corresponding one of said output ports regardless of the rotational position of said input ports relative to said output ports.

8. Apparatus for loading and unloading as defined in claim 5 including means for raising and lowering the lower end of each of said vertical conduit members to pivotally move said vertical conduit members about their upper ends.

9. Apparatus for loading and unloading as defined in claim 8 wherein said means for raising and lowering the lower end of each of said vertical conduit members includes a sheave secured to the pivotal upper end of each of said vertical conduit members, a pair of cables, means securing one end of each of said cables to said sheave, and power means secured to the other end of each of said cables to provide power for pivotally moving said sheave and said vertical conduit members about a horizontal axis.

10. Apparatus for loading and unloading as defined in claim 5 including means for mounting said plurality of vertical conduit members one above the other when said vertical conduit members are in a generally horizontal position.

11. Apparatus for loading and unloading as defined in claim 1 including means for raising and lowering the lower end of each of said vertical conduit members to pivotally move said vertical conduit members about their upper ends.

12. Apparatus for loading and unloading as defined in claim 11 wherein said means for raising and lowering the lower end of each of said vertical conduit members includes a sheave secured to the pivotal upper end of each of said vertical conduit members, a pair of cables, means securing one end of each of said cables to said sheave, and power means secured to the other end of each of said cables to provide power for pivotally moving said sheave and said vertical conduit members about a horizontal axis.

* * * * *